United States Patent [19]

Adachi et al.

[11] 4,233,875

[45] Nov. 18, 1980

[54] ELECTRONIC MUSICAL INSTRUMENT WITH AUTOMATIC TRILL PERFORMANCE FUNCTION

[75] Inventors: Takeshi Adachi; Masahiko Koike; Toshiyuki Takahashi, all of Hamamatsu, Japan

[73] Assignee: Nippon Gakki Seizo Kabushiki Kaisha, Hamamatsu, Japan

[21] Appl. No.: 939,954

[22] Filed: Sep. 6, 1978

[30] Foreign Application Priority Data

Sep. 8, 1977 [JP] Japan ..... 52-108279

[51] Int. Cl.[3] ..... G10H 1/02

[52] U.S. Cl. ..... 84/1.24; 84/1.03; 84/1.01

[58] Field of Search ..... 84/1, 24, 1.03, DIG. 23, 84/1.01, 1.25; 331/47, 179

[56] References Cited

U.S. PATENT DOCUMENTS

| | | | |
|---|---|---|---|
| 3,408,572 | 10/1968 | Wolf et al. | 331/179 |
| 3,701,040 | 10/1972 | Borrenic et al. | 84/1.25 |
| 3,965,789 | 6/1976 | Pearlman | 84/1.24 |
| 3,978,754 | 9/1976 | Adachi | 84/1.24 |

OTHER PUBLICATIONS

R. Moog, "Voltage-Controlled Electronic Music Modules," Journal of the Audio Engineering Society, Jul. 1965, vol. 13, No. 3, pp. 200-206.

*Primary Examiner*—J. V. Truhe
*Assistant Examiner*—Forester W. Isen
*Attorney, Agent, or Firm*—Frishauf, Holtz, Goodman & Woodward

[57] ABSTRACT

An electronic musical instrument comprises a keyboard circuit providing a pitch determining voltage signal whose magnitude corresponds to the note of a key depressed, a rectangular wave generation circuit generating a rectangular wave voltage signal, and a voltage controlled oscillator connected to receive the pitch determining voltage signal and the rectangular wave voltage signal to produce alternately first and second tone signals for trill performance. The tone pitch of the first tone signal depends on the magnitude of pitch determining voltage signal and the tone pitch of the second tone signal depends on the magnitudes of pitch determining voltage signal and rectangular wave voltage signal. The musical intervals between tone pitches of the first and second tone signals depends on the magnitude of rectangular wave voltage signal.

8 Claims, 3 Drawing Figures

ELECTRONIC MUSICAL INSTRUMENT WITH AUTOMATIC TRILL PERFORMANCE FUNCTION

BACKGROUND OF THE INVENTION

This invention relates to an electronic musical instrument and, more particularly, to an electronic musical instrument with an automatic trill performance function.

With conventional keyboard musical instruments such as pianos, a trill performance in which two muscial tones having different pitches (usually apart from each other by a major or a minor second degree interval) are alternated is sometimes conducted during performance of a musical composition in order to enhance musical effects.

With a conventional keyboard type electronic musical instrument, such a trill performance is possible, but it is very difficult for beginners, particularly, for children to play trills during performance of a musical composition.

SUMMARY OF THE INVENTION

It is an object of this invention to provide an electronic musical instrument which enables a trill performance by means of an ordinary keyboard operation for melody performance.

An electronic musical instrument according to one embodiment of this invention comprises keyboard circuit means for providing a pitch determining voltage signal; rectangular wave generation circuit means; and a voltage-controlled oscillator coupled to the keyboard circuit means and rectangular wave generation circuit means to produce alternately first and second tone signals.

The tone pitch of the first tone signal is a function of the magnitude of the pitch determining voltage signal form the keyboard circuit means and the tone pitch of the second tone signal is a function of the magnitude of the pitch determining voltage signal and the magnitude of the rectangular wave voltage signal from the rectangular wave generation circuit means.

The interval between the first and second tone signals depends on the magnitude (amplitude) of the rectangular wave voltage signal applied to the voltage-controlled oscillator. The magnitude of rectangular wave signal applied to the voltage-controlled oscillator may be manually varied by means of a level adjuster.

An electronic musical instrument according to another embodiment of this invention comprises, in addition to the aforesaid keyboard circuit means, rectangular wave generation circuit means and voltage-controlled oscillator, a voltage-controlled amplifier coupled to the voltage-controlled oscillator and arranged to control the amplitude envelope of an output signal of the voltage-controlled oscillator in accordance with a time-varying control waveform, and a control waveform generator for producing a time-varying control waveform which is applied to the voltage-controlled amplifier.

With this embodiment, the keyboard circuit means produces a pitch determining voltage signal having a magnitude (d.c. voltage value) which is a function of the note of a key depressed and a trigger signal representing depression of the key, and the rectangular wave generation circuit means is responsive to the trigger signal from the keyboard circuit means to produce first and second rectangular wave voltage signals. The frequency of the first rectangular wave voltage signal is higher than, preferably two times that of the second rectangular wave voltage signal.

The second rectangular wave voltage signal is applied to the voltage-controlled oscillator together with the pitch determining voltage signal, and the first rectangular wave voltage signal is applied to the control waveform generator to cause it to generate (synchronously repeat) the time-varying control waveform. With this embodiment, the amplitude envelope of each of the first and second tone signals is controlled in accordance with the time-varying control waveform.

As in a conventional synthesizer type electronic musical instrument, a voltage-controlled filter may be provided between the voltage-controlled oscillator and the voltage-controlled amplifier, and a control waveform generator may be provided which is coupled to the voltage-controlled filter. Further, a control waveform generator may be provided for the voltage-controlled oscillator.

DESCRIPTION OF THE PREFERRED EMBODIMENT

Figure 1:
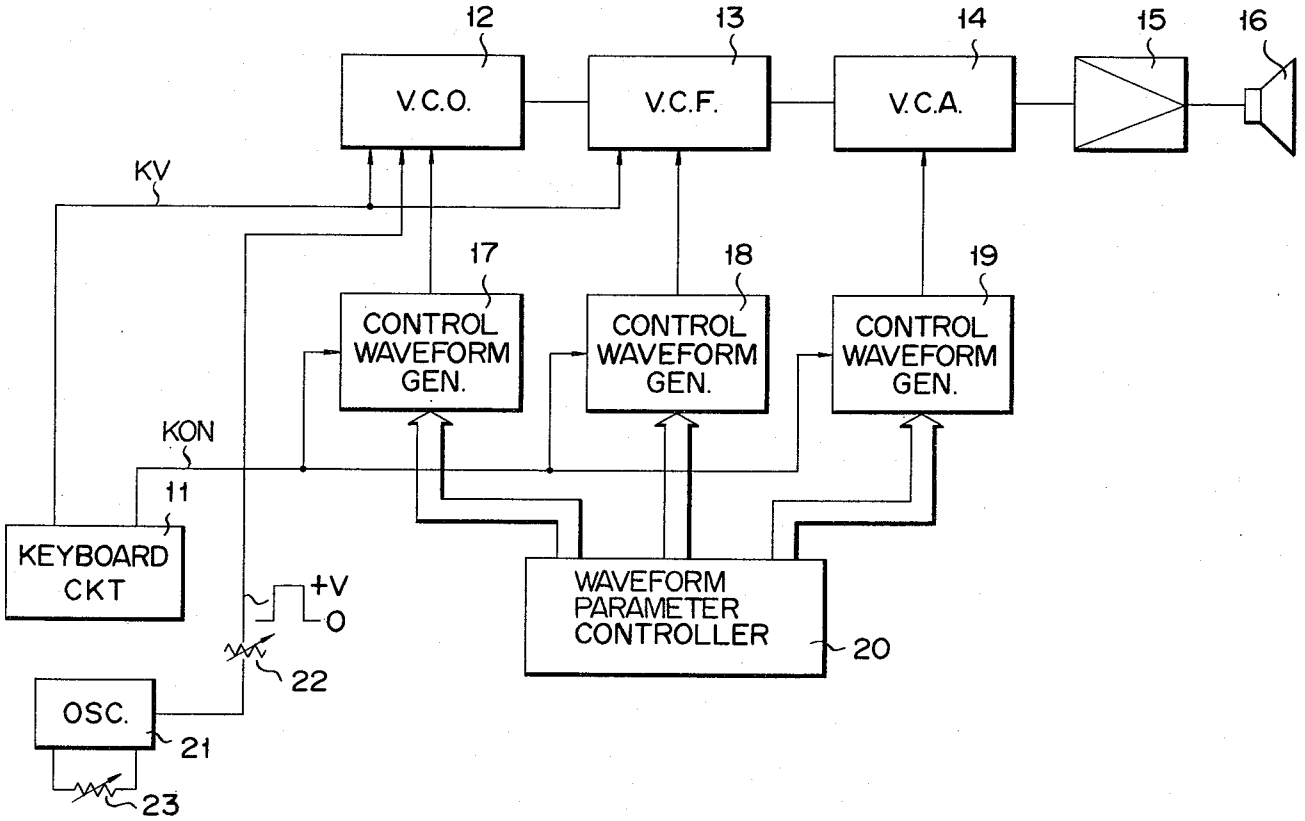
FIG. 1 shows a schematic block diagram of an electronic musical instrument according to one embodiment of this invention.

There will now be described an embodiment of this invention with reference to FIG. 1.

In the figure, reference numeral 11 designates a keyboard circuit having keys and arranged to provide, when a key is depressed, a pitch determining voltage signal (hereinafter referred to as KV signal) having a magnitude which is a function of notes (depressed keys) in a musical scale, and a trigger signal (hereinafter referred to as KON signal) representing the depression of the key.

The KV signal is coupled to a voltage-controlled frequency-variable oscillator (hereinafter referred to as VCO) 12 which produces a tone signal corresponding to the note of the depressed key. The output tone signal of VCO 12 is applied in turn to a voltage-controlled frequency-characteristic-variable filter (hereinafter referred to as VCF) 13 and a voltage-controlled gain-variable amplifier (hereinafter referred to as VCA) 14. The output signal is applied to a sound reproduction system including a suitable power amplifier 15 and a loudspeaker 16, where the tone signal is sounded.

The KV signal is applied also to VCF 13 so that it has a cutoff-frequency appropriate to the note of the depressed key.

Control waveform generators 17, 18 and 19 are provided for VCO 12, VCF 13 and VCA 14, respectively, and are triggered by the KON signal from the keyboard circuit 11 to produce time-varying control waveforms. The time-varying control waveforms have, as is well known, controllable parameters such as attack time, attack level, first decay time, sustain level and second decay time which define the shape of the control waveform. A manually operable waveform parameter controller 20 is provided to apply parameter control signals to the respective control waveform generators 17, 18 and 19. Due to provision of the control waveform generator 17, the oscillation frequency of VCO 12 is caused to vary in accordance with the contour of the control waveform from the control waveform generator 17. VCF 13 has its cutoff-frequency varied in accordance with the contour of the control waveform from the control waveform generator 18 so that the tone color of the tone signal being produced varies with time. VCA 14 has its gain controlled in accordance with the output waveform from the waveform generator 19 so that the tone signal being produced is furnished with an amplitude envelope according to the contour of control waveform from the control waveform generator 19.

The construction of an electronic muscial instrument so far described has been already known in the art. According to this invention, a rectangular wave generator 21 is provided whose output rectangular wave voltage signal is applied to VCO 12. The rectangular wave voltage signal may be controlled, in magnitude (i.e. amplitude), by a level adjuster 22. The rectangular wave voltage signal may have a frequency of several Hz, for example, about 5 Hz. The rectangular wave generator 21 may be of a frequency-variable type whose frequency can be controlled by a variable resistor 23.

The rectangular wave voltage signal applied to VCO 12 has voltage levels of 0 and +V. VCO 12 is constructed such that no oscillation occurs at an inout level of 0 volt. Accordingly, VCO 12 produces, when receiving the KV signal from the keyboard circuit 11 and the rectangular wave voltage signal from the generator 21, first and second tone signals of a different pitch alternately, to thereby enable a trill performance under only one key operation. The tone pitch of the tone signal produced when the rectangular wave voltage signal is at 0 volt depends only on the KV signal from the keyboard circuit 11 and corresponds to the note of the key being depressed. On the other hand, the tone pitch of the tone signal produced when the rectangular wave voltage signal is at +V volts depends on the KV signal from the keyboard circuit 11 and the rectangular wave voltage signal from the generator 21. The musical interval between these two tone signals being produced alternately depends on the magnitude (+V) of rectangular wave voltage signal.

In VCO 12, the rectangular wave voltage signal may be multiplied by the KV signal and then the resultant multiplied rectangular wave voltage signal and the KV signal is added together to control the oscillation frequency of VCO 12. As a result of this, the interval (in terms of scale degree) between two tones for trill performance can be approximately uniform over the compass of an electronic musical instrument, and VCO 12 produces no tone signal unless a pitch determining voltage signal is applied to VCO 12.

Figure 2:
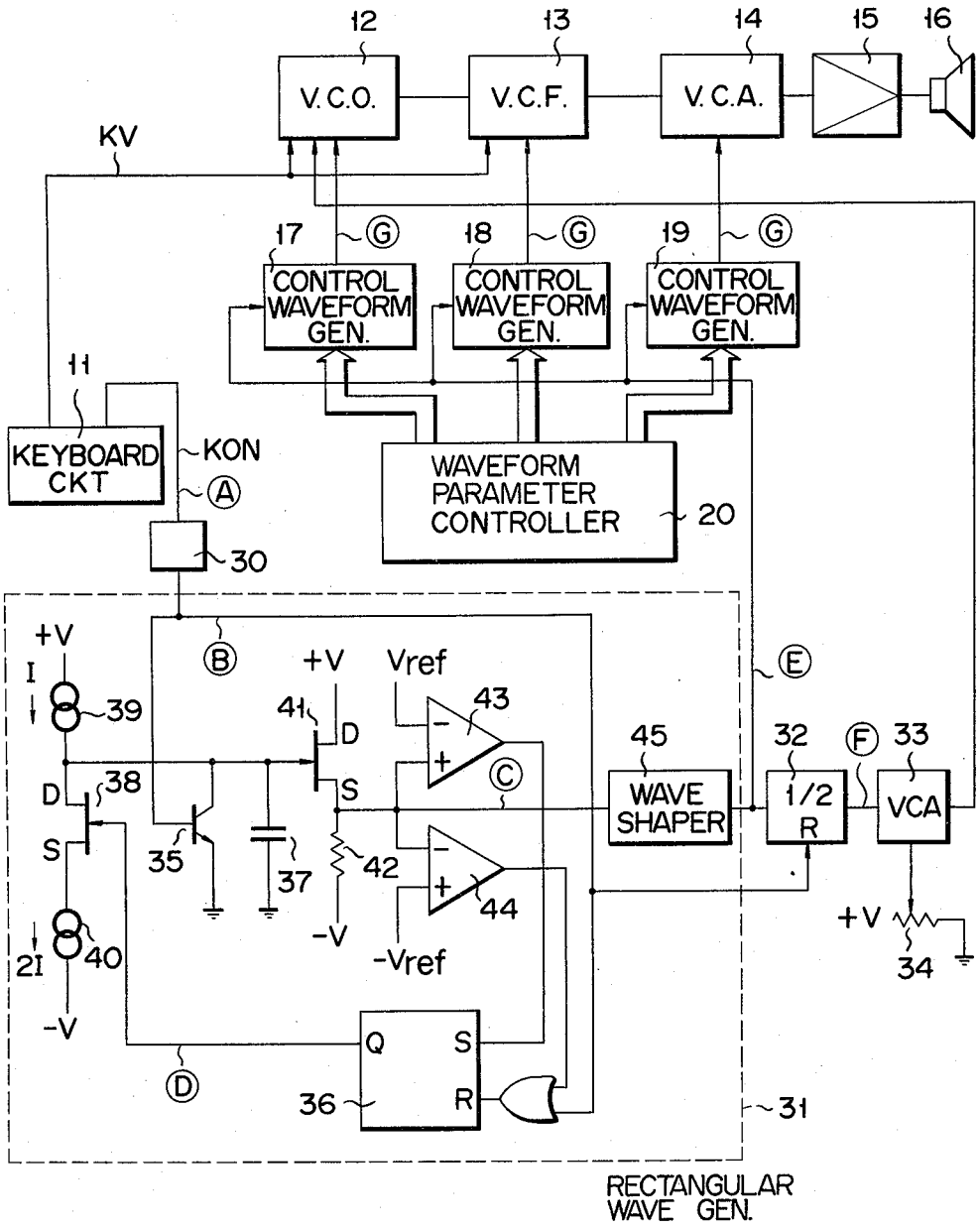
FIG. 2 shows a schematic block and circuit diagram of an electronic musical instrument according to another embodiment of this invention.

FIG. 2 shows another embodiment of this invention, and the same parts as those of FIG. 1 are designated by like numerals, the descriptions thereof being omitted. In this embodiment, a KON signal from the keyboard circuit 11 is differentiated by a differentiator 30 and used to trigger a rectangular wave generator 31. An output signal of the rectangular wave generator 31 is applied to the control waveform generators 17, 18 and 19 to produce time-varying control waveforms. The output of rectangular wave generator 31 is coupled to VCO 12 through a divide-by-two (binary) counter 32 which is reset at the instant of key depression and to a VCA 33. VCA 33 is connected to the slider of a potentiometer 34 connected across a DC power source to adjust the magnitude of rectangular wave voltage signal to be applied to VCO 12. Due to provision of the divide-by-two counter 32, the frequency of rectangular wave voltage signal applied to VCO 12 is half that of rectangular wave voltage signal applied to the control waveform generators 17, 18 and 19.

The rectangular wave generator 31 comprises a bipolar transistor 35 which is rendered ON, and a flip-flop circuit 36 which is reset, by an output pulse (FIG. 3B) of the differentiator 30 responsive to negative-going transition (spike) of the KON signal (FIG. 3A) at the instant of the key depression. A capacitor 37 is connected in parallel with the collector-emitter path of the transistor 35. One end of the capacitor 37 having the other end connected to ground is connected to the drain of a field effect transistor 38. The transistor 38 has its drain connected to a constant current source 39 of a constant current I, and its source connected to a constant current source 40 of a constant current 2I. The gate of the transistor 38 is connected to the set output Q of the flip-flop circuit 36. The terminal voltage of the capacitor 37 is coupled to the gate of a transistor 41 having its source connected to a load resistor 42 to constitute a high input impedance buffer circuit. The source-follower output of the transistor 41 is coupled to a waveshaper 45 for providing a rectangular output, the noninverting input of a first operational amplifier 43, and the inverting input of a second operational amplifier 44. A reference voltage Vref is coupled to the inverting input of the first operational amplifier 43, and a reference voltage -Vref is coupled to the noninverting input of the second operational amplifier 44. The output of the first operational amplifier 43 is coupled to the set input of the flip-flop circuit 36 and the output of the second operational amplifier 44 is coupled to the reset input of the flip-flop circuit 36.

Figure 3:
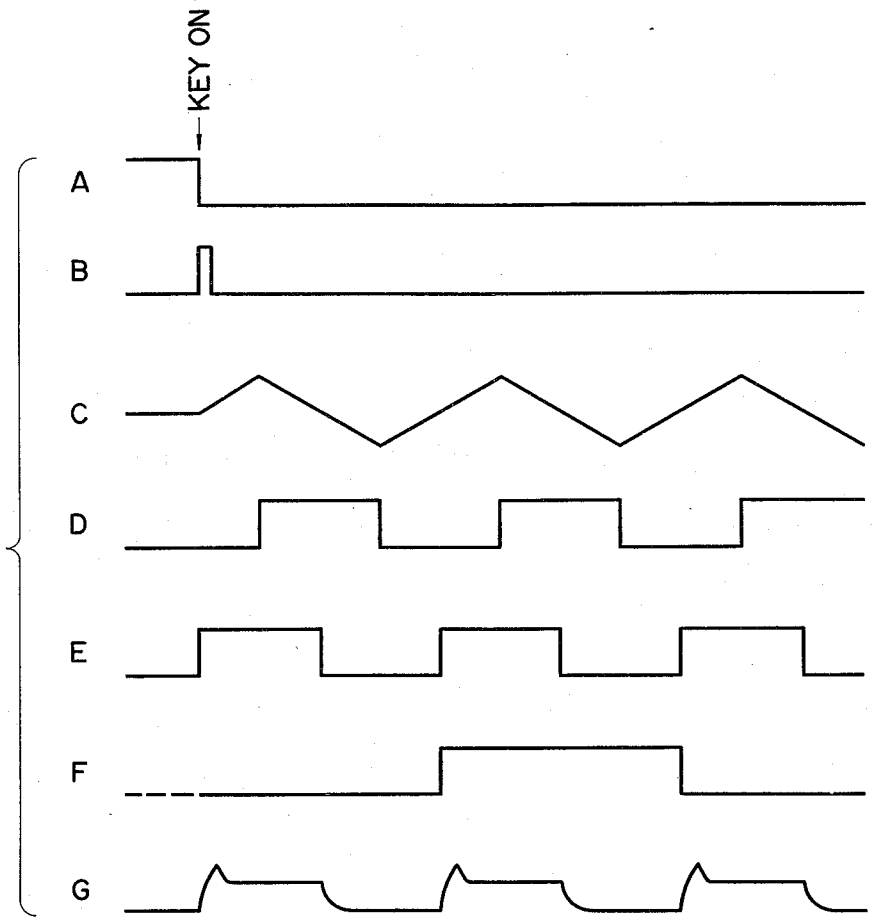
FIG. 3 is a timing chart useful in explaining the operation of electronic musical instrument of FIG. 2.

In operation of the abovementioned rectangular wave generator 31, the transistor 35 is rendered conductive to discharge the capacitor 37 at the instant of key depression. Since the flip-flop circuit 36 is reset, the transistor 38 is nonconductive. After the transistor 35 is rendered nonconductive, the capacitor 37 is charged by the constant current I and thus the terminal voltage of the capacitor 37 increases with time as shown in FIG. 3C. The source-follower output of the transistor 41 has substantially the same voltage as the capacitor 37. The instant the source-follower output exceeds Vref, the output of the operational amplifier 43 is made HIGH so that the flip-flop circuit 36 is set. As a result, the transistor 38 conducts. Since the constant current source 40 is connected to the source of the transistor 38 the constant current 2I flows through the transistor 38. The half part of the current 2I is supplied by the current source 39 and the remaining half part of 2I is supplied from ground through the capacitor 37. Namely, the terminal voltage of the capacitor 37 and the source voltage of the transistor 41 decreases with time in the negative direction as shown in FIG. 3C. When the source voltage of the transistor 41 exceeds Vref, the output of the operational amplifier 44 is made HIGH so that the flip-flop circuit 36 is reset as shown in FIG. 3D with the result that the transistor 38 is rendered nonconductive.

The capacitor 37 is supplied with the constant current I from the constant current source 39 and thus the terminal voltage of the capacitor 37 increases with time as shown in FIG. 3C. In this way, the terminal voltage of the capacitor 37 and the source voltage of the transistor 41 vary like a triangle wave as shown in FIG. 3C. The triangle wave output voltage of the transistor 41 is converted, by the waveshaper 45, into a rectangular wave output voltage as shown in FIG. 3E.

Since the frequency divider 32 is reset at the instant of key depression, the output of the divider 32 is held at LOW level during the first period of the output voltage of the waveshaper 45. At the instant of key depression, therefore, VCO 12 produces a tone signal corresponding to the note of a key depressed without fail because the output of the frequency divider 32 is coupled to VCO 12.

The output of the waveshaper 45 (FIG. 3E) is coupled to the control waveform generators 17, 18 and 19 so that the control waveforms are produced during the first half portion of one cycle period of the waveform 3E, which period corresponds to one half portion of the output period of the frequency divider which designates either of the two notes for trill performance. That is, each of the first and second tone signals alternately produced by VCO 12 in response to the waveform 3F is controlled (i.e. sounded) by the control waveform during the first half period of the respective generation period of the respective tones. Since VCA 14 acting also as a keyer is disabled by the LOW level output of the control waveform generator 19, the first and second tones which have been controlled in frequency, tone color, and amplitude envelope by the control waveforms are voiced by the loudspeaker 16.

What we claim is:

1. An electronic musical instrument with automatic trill performance, comprising:

keyboard circuit means for providing a pitch determining voltage signal;

rectangular wave generating means for generating a trill controlling rectangular wave voltage signal having a predetermined frequency; and a voltage-controlled frequency-variable oscillator coupled to said keyboard circuit means and to said rectangular wave generating means and responsive to application of the pitch determining voltage signal and the rectangular wave voltage signal thereto to produce an automatic trill performance by automatically alternately generating first and second tone signals corresponding to respective notes of a musical scale, said first and second tone signals alternating at said predetermined frequency, the tone pitch of said first tone signal being a function of the magnitude of the pitch determining voltage signal, and the tone pitch of said second tone signal being a function of the magnitude of the rectangular wave signal and the magnitude of the pitch determining voltage signal.

2. An electronic musical instrument with automatic trill performance, comprising:

keyboard circuit means for providing a pitch determining voltage signal;

rectangular wave generating means for generating first and second rectangular wave voltage signals, the frequency of the first rectangular wave signal being higher than that of the second rectangular wave signal;

a voltage-controlled frequency-variable oscillator coupled to said keyboard circuit means and to said rectangular wave generating means and responsive to application of the pitch determining voltage signal and the second rectangular wave voltage signal thereto to produce an automatic trill performance by alternately generating first and second tone signals, the tone pitch of the first tone signal being a function of the magnitude of the pitch determining voltage signal and the tone pitch of the second tone signal being a function of the magnitude of the second rectangular wave signal and the magnitude of the pitch determining voltage signal;

a voltage-controlled amplifier coupled to said voltage-controlled oscillator and responsive to application of a time-varying control waveform thereto to control the amplitude envelope of an output signal of said voltage-controlled oscillator in accordance with the time-varying control waveform; and control waveform generating means coupled to said voltage-controlled amplifier and to said rectangular wave generating means and responsive to application of the first rectangular wave signal thereto to produce a time-varying control waveform which is coupled to said voltage-controlled amplifier.

3. An electronic musical instrument according to claim 2 wherein the frequency of the first rectangular wave signal is twice that of the second rectangular wave signal.

4. An electronic musical instrument with automatic trill performance, comprising:

keyboard circuit means having keys and providing a pitch determining voltage signal whose magnitude is a function of the note of a key depressed and a trigger signal representing depression of the key;

rectangular wave generating means coupled to said keyboard circuit means and responsive to application of the trigger signal thereto to initiate generation of a first rectangular wave voltage signal;

a frequency divider for frequency-dividing the first rectangular wave signal to produce a second rectangular wave voltage signal;

a voltage-controlled frequency-variable oscillator coupled to said keyboard circuit means and to said frequency divider and responsive to application of the pitch determining voltage signal and the second rectangular wave voltage signal thereto to produce an automatic trill performance by alternately generating first and second tone signals, the tone pitch of the first tone signal being a function of the magnitude of the pitch determining voltage signal and the tone pitch of the second tone signal being a function of the magnitude of the second rectangular wave voltage signal and the magnitude of the pitch determining voltage signal;

a voltage-controlled amplifier coupled to said voltage-controlled oscillator and responsive to application of a time-varying control waveform thereto to control the amplitude envelope of an output signal of said voltage-controlled oscillator in accordance with the time-varying control waveform; and control waveform generating means coupled to said voltage-controlled amplifier and to said rectangular wave generating means and responsive to application of the first rectangular wave signal from said rectangular wave generating means to produce a time-varying control wave-form which is applied to said voltage-controlled amplifier.

5. An electronic musical instrument according to claim 4 wherein said frequency divider is arranged to divide the first rectangular wave signal by a factor of two.

6. An electronic musical instrument according to claim 4 wherein said frequency divider is coupled to said keyboard circuit means so that said frequency divider is initially reset upon generation of the trigger signal.

7. An electronic musical instrument according to claim 4, further comprising means coupled between said frequency divider and said voltage-controlled oscillator for controlling the magnitude of the second rectangular wave voltage signal.

8. An electronic musical instrument according to claim 4, further comprising a voltage-controlled filter coupled between said voltage-controlled oscillator and said voltage-controlled amplifier, and second control waveform generating means coupled to said voltage-controlled filter and to said frequency divider for controlling said voltage-controlled filter to produce trill tones.

* * * * *